US008471539B2

(12) United States Patent
Wu

(10) Patent No.: US 8,471,539 B2
(45) Date of Patent: Jun. 25, 2013

(54) LOW DROP OUT VOLTAGE REGULATO

(75) Inventor: Chen-Yu Wu, Yilan County (TW)

(73) Assignee: Winbond Electronics Corp., Taichung (TW)

( * ) Notice: Subject to any disclaimer, the term of this patent is extended or adjusted under 35 U.S.C. 154(b) by 301 days.

(21) Appl. No.: 12/978,383

(22) Filed: Dec. 23, 2010

(65) Prior Publication Data

US 2012/0161734 A1 Jun. 28, 2012

(51) Int. Cl.
*G05F 1/565* (2006.01)

(52) U.S. Cl.
USPC ..... 323/275

(58) Field of Classification Search
USPC ..... 323/280, 281, 274, 17, 234, 237, 323/273–275, 282–285
See application file for complete search history.

(56) References Cited

U.S. PATENT DOCUMENTS 6,867,573 B1 * 3/2005 Carper ..... 323/277
7,215,187 B2 5/2007 Lam et al.
7,902,801 B2 * 3/2011 Mandal ..... 323/273
7,986,499 B2 * 7/2011 Wang et al. ..... 361/18
8,115,463 B2 * 2/2012 Wang ..... 323/280
8,169,202 B2 * 5/2012 Chen ..... 323/273
8,169,203 B1 * 5/2012 Vemula ..... 323/273
2003/0218450 A1 * 11/2003 Bonte ..... 323/273
2005/0189930 A1 * 9/2005 Wu et al. ..... 323/280

OTHER PUBLICATIONS

Lam et al., "Adaptively-Biased Capacitor-Less CMOS Low Dropout Regulator with Direct Current Feedback", Jan. 24-27, 2006, Design Automation, 2006. Asia and South Pacific Conference, Yokohama, Print ISBN: 0-7803-9451-8, pp. 104-105.

* cited by examiner

*Primary Examiner* — Adolf Berhane
*Assistant Examiner* — Jeffrey Gblende
(74) *Attorney, Agent, or Firm* — Jianq Chyun IP Office

(57) ABSTRACT

A low drop out (LDO) voltage regulator having an error amplifier, a power transistor, a first voltage division unit, a compensation control unit and a compensation bias current source is provided. The error amplifier generates a control voltage according to a first reference voltage and a feedback voltage. The power transistor generates an output voltage at a drain of the power transistor according to the control voltage. The first voltage division unit divides the output voltage to generate the feedback voltage. The compensation control unit generates a compensation control signal to the compensation bias current source according to the control voltage, the output voltage and a compensation bias, so as to make the compensation bias current source generate a compensation bias current, in which the compensation bias is inversely proportional to a supply voltage and ambient temperature.

13 Claims, 5 Drawing Sheets

LOW DROP OUT VOLTAGE REGULATO

BACKGROUND OF THE INVENTION

1. Field of the Invention

The present invention generally relates to a low drop out (LDO) voltage regulator, in particular, to an LDO voltage regulator having a quick transient response.

2. Description of Related Art

Two types of conventional voltage converting circuits exist, namely, a switching regulator and a linear regulator, in which the linear regulator commonly used in buck applications is an LDO regulator. The LDO regulator is characterized in having a low production cost, a simple circuit, and low noises, and is capable of supplying a stable output voltage, so as to be widely applied to various types of portable electronic products. The response speed and system stability are important parameters for evaluating the voltage converting circuit.

SUMMARY OF THE INVENTION

Accordingly, the present invention is directed to an LDO voltage regulator having a quick transient response.

The present invention provides an LDO voltage regulator, which includes an error amplifier, a power transistor, a first voltage division unit, a compensation control unit, and a compensation bias current source. The error amplifier generates a control voltage according to a first reference voltage and a feedback voltage. The power transistor has a gate coupled to the error amplifier and a source coupled to a supply voltage, for generating an output voltage at a drain of the power transistor according to the control voltage. The first voltage division unit is coupled between the drain of the power transistor and a ground, for dividing the output voltage to generate the feedback voltage. The compensation control unit is coupled between the gate and the drain of the power transistor, for generating a compensation control signal according to the control voltage, the output voltage, and a compensation bias. The compensation bias current source is coupled to the error amplifier, for supplying a compensation bias current to the LDO voltage regulator according to the compensation control signal.

In an embodiment of the present invention, the LDO voltage regulator further includes a voltage and temperature compensation module, coupled to the compensation control unit, for generating the compensation bias, and regulating the compensation bias according to changes of the supply voltage and ambient temperature, in which the compensation bias is inversely proportional to the supply voltage and the ambient temperature.

In an embodiment of the present invention, the LDO voltage regulator further includes a bias current source, coupled to the error amplifier, for supplying a bias current to the error amplifier.

Based on the above mentioned, in the present invention, a compensation control unit outputs a compensation control signal according to a control voltage of a gate of a power transistor, an output voltage of an LDO voltage regulator, and a compensation voltage generated by the voltage and temperature compensation module, such that a compensation bias current source supplies an additional compensation bias current to an error amplifier, so as to accelerate a load transient response of the LDO voltage regulator, and compensate the changes of a supply voltage and ambient temperature.

The features and efficacies of the present invention will become apparent from the detailed description of the embodiments given hereinafter with the accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
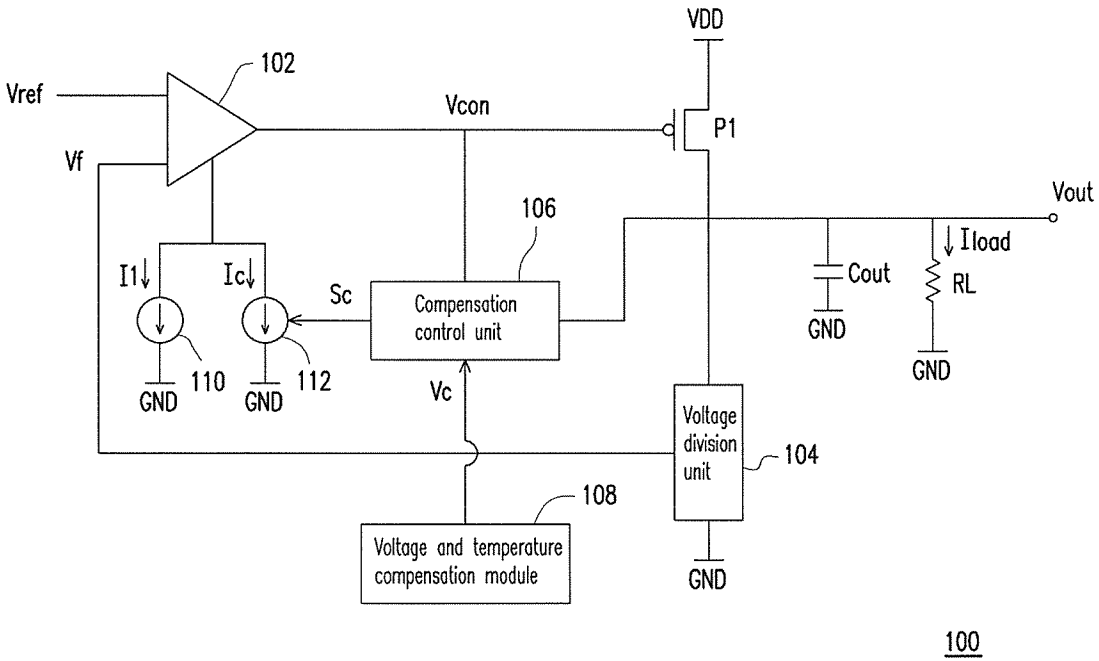
FIG. 1 is a schematic view of an LDO voltage regulator according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a schematic view of an LDO voltage regulator according to an embodiment of the present invention. Referring to FIG. 1, the LDO voltage regulator 100 includes an error amplifier 102, a power transistor P1, a voltage division unit 104, a compensation control unit 106, a voltage and temperature compensation module 108, a bias current source 110, and a compensation bias current source 112. The bias current source 110 and the compensation bias current source 112 are coupled to the error amplifier 102, an input end of the error amplifier 102 is coupled to a reference voltage Vref, and an output end of the error amplifier 102 is coupled to a gate of the power transistor P1. A source and a drain of the power transistor P1 are respectively coupled to a supply voltage VDD and the voltage division unit 104. The voltage division unit 104 is coupled among the drain of the power transistor P1, the other input end of the error amplifier 102, and a ground GND. The compensation control unit 106 is coupled to the gate and the drain of the power transistor P1, the voltage and temperature compensation module 108, and the compensation bias current source 112. In addition, the drain of the power transistor P1 (that is, an output end of the LDO voltage regulator 100) is coupled to a load capacitor Cout and a load resistor RL, and a load current Iload flows to the ground GND through the load resistor RL.

The bias current source 110 is used to supply a bias current I1 to the error amplifier 102. The error amplifier 102 generates a control voltage Vcon to the gate of the power transistor P1 on the output end of the error amplifier 102 according to the reference voltage Vref and a feedback voltage Vf, so as to regulate a voltage level of an output voltage Vout. The voltage division unit 104 divides the output voltage Vout to generate the feedback voltage Vf. The voltage and temperature compensation module 108 is used to generate a compensation bias Vc, and regulate the compensation bias Vc according to changes of the supply voltage VDD and ambient temperature, in which the compensation bias Vc is inversely proportional to the supply voltage VDD and the ambient temperature.

In addition, the compensation control unit 106 is used to detect changes of voltage levels of the control voltage Vcon and the output voltage Vout, and output a compensation control signal Sc to the compensation bias current source 112 according to the control voltage Vcon, the output voltage Vout, and the compensation bias Vc. The compensation bias current source 112 supplies an additional compensation bias current Ic to the LDO voltage regulator 100 according to the compensation control signal Sc, so as to accelerate a load transient response of the LDO voltage regulator 100, such that the output voltage Vout of the LDO voltage regulator 100 is quickly pulled to a stable state.

Figure 2:
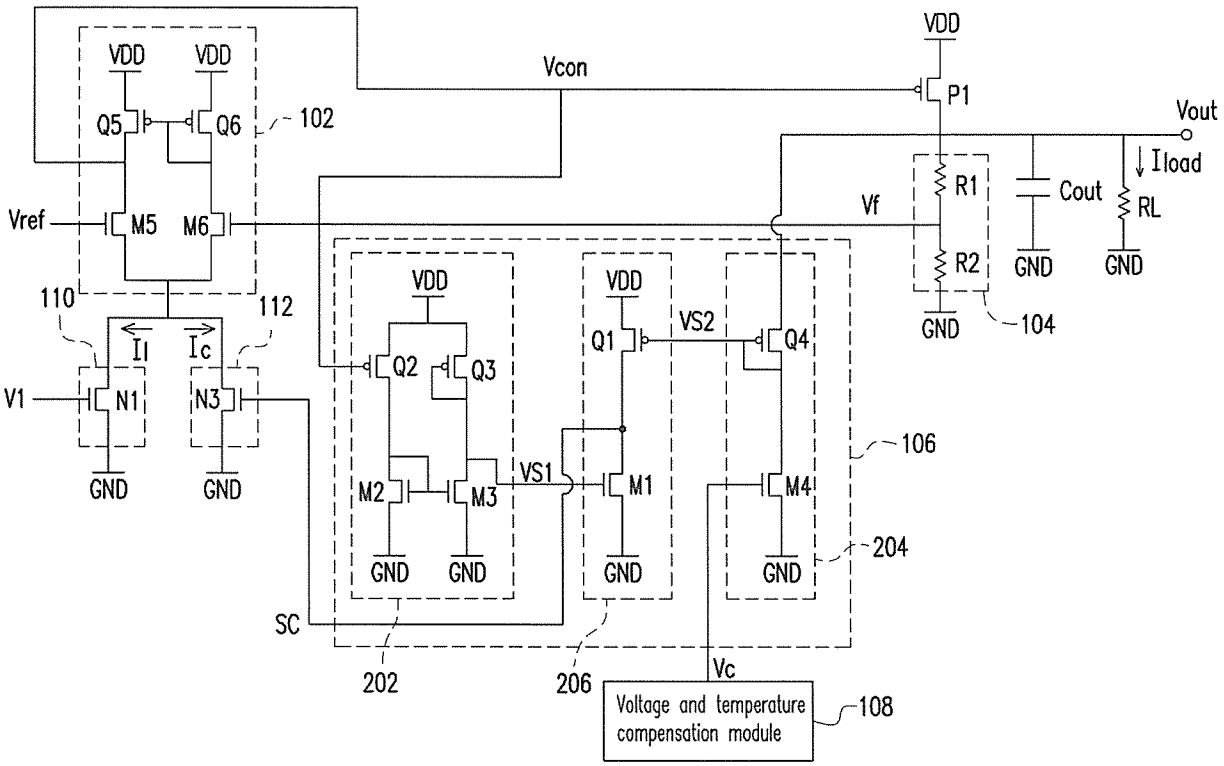
FIG. 2 is a schematic view of an LDO voltage regulator according to another embodiment of the present invention.

Further, the LDO voltage regulator 100 according to the embodiment of FIG. 1 may be implemented in a manner of an embodiment of FIG. 2. FIG. 2 is a schematic view of an LDO voltage regulator according to another embodiment of the present invention. Referring to FIG. 2, in this embodiment, the error amplifier 102 includes P-type transistors Q5 and Q6 and N-type transistors M5 and M6. A gate of the P-type transistor Q5 is coupled to a gate of the P-type transistor Q6, and a source and a drain of the P-type transistor Q5 are respectively coupled to the supply voltage VDD and the gate of the power transistor P1. A gate of the N-type transistor M5 is coupled to the reference voltage Vref, a drain is coupled to the drain of the P-type transistor Q5, and a source of the N-type transistor M5 is coupled to the bias current source 110 and the compensation bias current source 112. A source and a drain of the P-type transistor Q6 are respectively coupled to the supply voltage VDD and a drain of the N-type transistor M6, and a gate and a drain of the P-type transistor Q6 are coupled to each other. In addition, a source of the N-type transistor M6 is coupled to the source of the N-type transistor M5, and a gate of the N-type transistor M6 is coupled to the voltage division unit 104. The error amplifier 102 respectively receives the reference voltage Vref and the feedback voltage Vf generated by the voltage division unit 104 through the N-type transistors M5 and M6, and outputs the control voltage Vcon to the gate of the power transistor P1 at a common node of the P-type transistor Q5 and the N-type transistor M5, so as to control the power transistor P1 to output the output voltage Vout at the drain.

The voltage division unit 104 includes a resistor R1 and a resistor R2. The resistors R1 and R2 are serially connected between the drain of the power transistor P1 and the ground GND, and a common node of the resistors R1 and R2 is coupled to the gate of the N-type transistor M6, so as to output the feedback voltage Vf to the N-type transistor M6. The compensation bias current source 112 includes an N-type transistor N3, having a drain and a source respectively coupled to a common node of the N-type transistors M5 and M6 and the ground GND, and a gate coupled to the compensation control unit 106. It should be noted that the error amplifier 102, the voltage division unit 104, the bias current source 110, and the compensation bias current source 112 are only an exemplary embodiment, and the present invention is not limited thereto in practical applications.

In addition, the compensation control unit 106 includes a drop out detection unit 202, a drop out detection unit 204, and a compensation control signal generating unit 206. In this embodiment, the drop out detection unit 202 includes P-type transistors Q2 and Q3 and N-type transistors M2 and M3. The drop out detection unit 204 includes a P-type transistor Q4 and an N-type transistor M4. The compensation control signal generating unit 206 includes a P-type transistor Q1 and an N-type transistor M1. A gate of the P-type transistor Q2 is coupled to the gate of the power transistor P1, a source and a drain of the P-type transistor Q2 are respectively coupled to the supply voltage VDD and a drain of the N-type transistor M2. A gate and a source of the N-type transistor M2 are respectively coupled to a gate of the N-type transistor M3 and the ground GND, and the gate and the drain of the N-type transistor M2 are coupled to each other. A drain and a source of the N-type transistor M3 are respectively coupled to a gate of the N-type transistor Ml and the ground GND. A source and a drain of the P-type transistor Q3 are respectively coupled to the supply voltage VDD and the drain of the N-type transistor M3, and a gate and the drain of the P-type transistor Q3 are coupled to each other.

In the compensation control signal generating unit 206, the gate of the N-type transistor M1 is coupled to the drain of the N-type transistor M3, a drain and a source of the N-type transistor M1 are respectively coupled to a drain of the P-type transistor Q1 and the ground GND, and a source and a gate of the P-type transistor Q1 are respectively coupled to the supply voltage VDD and a gate of the P-type transistor Q4. Further, in the drop out detection unit 204, a source and a drain of the P-type transistor Q4 are respectively coupled to the drain of the power transistor P1 and a drain of the N-type transistor M4, and the gate and the drain of the P-type transistor Q4 are coupled to each other. A gate and a source of the N-type transistor M4 are respectively coupled to the voltage and temperature compensation module 108 and the ground GND.

The drop out detection unit 202 is used to detect the voltage level of the control voltage Vcon output by the error amplifier 102, and accordingly output a compensation signal VS1. The drop out detection unit 204 is used to detect the voltage level of the output voltage Vout, and output a compensation signal VS2 according to the output voltage Vout and the compensation bias Vc. The compensation control signal generating unit 206 outputs the compensation control signal according to the compensation signals VS1 and VS2, so as to control the compensation bias current source 112 to generate the compensation bias current Ic, thereby accelerating the load transient response of the LDO voltage regulator 100.

For example, when the LDO voltage regulator 100 is operated with a heavy load current, in order to supply a large load current Iload, the load capacitor Cout needs to first discharge the load resistor RL, so that the output voltage Vout drops, and a level of a gate voltage of the power transistor P1 (that is, the control voltage Vcon) is pulled down.

The drop of the output voltage Vout results in the drop of a drain voltage and a gate voltage of the P-type transistor Q4 (that is, the drop of the voltage level of the compensation signal VS2), leading to the rise of a level of a drain voltage of the P-type transistor Q1 (that is, a voltage level of the compensation control signal Sc), such that the drop of the output voltage Vout causes the N-type transistor N3 to be turned on, and the compensation bias current Ic is generated at the drain of the N-type transistor N3.

In another aspect, the pulled-down level of the gate voltage of the power transistor P1 (that is, the control voltage Vcon) results in the rise of a drain voltage of the N-type transistor M2 in the compensation control unit 106 (that is, the rise of a gate voltage of the N-type transistor M3), leading to the drop of a drain voltage of the N-type transistor M3 and a gate voltage of the N-type transistor Ml (that is, the drop of the voltage level of the compensation signal VS1). The drop of the gate voltage of the N-type transistor M1 results in the rise of a drain voltage of the N-type transistor Ml (that is, the rise of the voltage level of the compensation control signal Sc), so as to turn on the N-type transistor N3, and generate the compensation bias current Ic at the drain of the N-type transistor N3. Therefore, the drop of the gate voltage of the power transistor P1 is another way to raise the compensation bias current Ic. In this manner, the drop of the gate voltage of the power transistor P1 (that is, the control voltage Vcon) and the output voltage Vout is detected, and the gate voltage of the N-type transistor N3 (that is, the voltage level of the compensation control signal Sc) is increased accordingly, such that an additional compensation bias current Ic is provided at the drain of the N-type transistor N3, and the load transient response of the LDO voltage regulator 100 is enhanced; thereby, the error amplifier quickly reduces the voltage level of the control voltage Vcon, to turn on the power transistor P1 and supply the current to the load capacitor Cout for achieving a voltage stabilization effect.

Figure 3A:
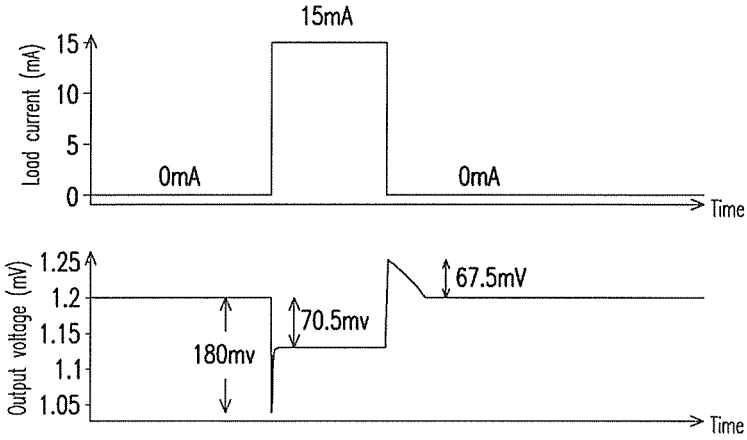
FIG. 3A is a schematic view showing a simulation of a load transient response of a conventional LDO voltage regulator.
Figure 3B:
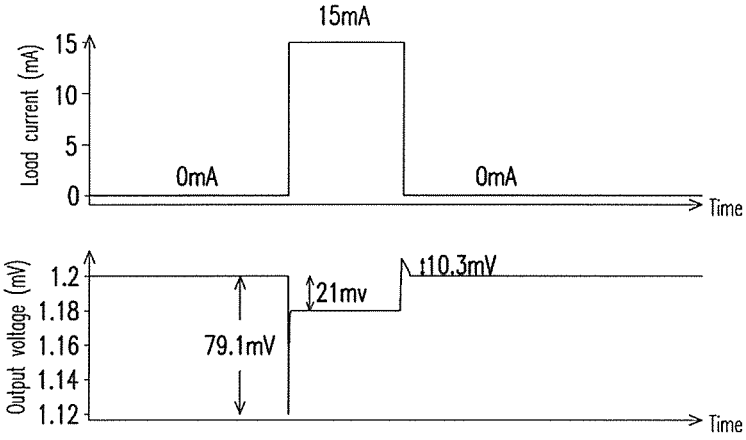
FIG. 3B is a schematic view showing a simulation of a load transient response of the LDO voltage regulator according to the embodiment of FIG. 2.

FIG. 3A is a schematic view showing an HSPICE simulation of a load transient response of a conventional LDO voltage regulator, and FIG. 3B is a schematic view showing a simulation of the load transient response of the LDO voltage regulator according to the embodiment of FIG. 2. Referring to FIGS. 3A and 3B, it can be clearly seen that when the load current Iload suddenly rises from 0 mA to 15 mA, an output voltage of the conventional LDO voltage regulator drops by 180 mV, and the output voltage of the LDO voltage regulator according to the present invention only drops by 79.1 mV. When the load current is maintained at 15 mA, the output voltage of the conventional LDO voltage regulator drops by 70.5 mV, and the output voltage of the LDO voltage regulator according to the present invention only drops by 21 mV. Therefore, the LDO voltage regulator of this embodiment has a desirable load regulation. In addition, when the load current Iload suddenly drops from 15 mA to 0 mA, the output voltage of the conventional LDO voltage regulator has a voltage glitch higher than a stable state voltage level for 67.5 mV, and a voltage glitch of the LDO voltage regulator according to the present invention is only 10.3 mV. Seen from the above, the LDO voltage regulator according to the present invention surely greatly improves the load transient response and the load regulation.

It should be noted that in order to quickly enhance the load transient response of the LDO voltage regulator 100, that is, to enable the compensation bias current source 112 to supply the compensation bias current Ic as soon as possible, it may be designed that when the LDO voltage regulator 100 is operated with no load or a light load, a gate bias of the N-type transistor N3 is slightly lower than a conduction voltage of the N-type transistor N3, such that in the LDO voltage regulator 100, when the load is changed, the N-type transistor N3 is quickly conducted to supply the compensation bias current Ic to the LDO voltage regulator 100, thereby accelerating the load transient response of the LDO voltage regulator 100.

In addition, in order to prevent the drift of the gate bias of the N-type transistor N3 due to changes of the supply voltage VDD and the ambient temperature. For example, when the supply voltage VDD or the ambient temperature rises, the gate bias of the N-type transistor N3 (that is, the voltage level of the compensation control signal Sc) rises accordingly, such that the LDO voltage regulator 100 without any load is conducted to generate the compensation bias current Ic to the LDO voltage regulator 100, and the LDO voltage regulator 100 generates unnecessary power consumption. Further, when the supply voltage VDD or the ambient temperature drops, the voltage level of the compensation control signal Sc drops accordingly, such that the LDO voltage regulator 100 cannot achieve the quick transient response. The compensation bias Vc generated by the voltage and temperature compensation module 108 compensates the changes of the supply voltage VDD and the ambient temperature, such that the voltage and temperature compensation module 108 performs voltage compensation and temperature compensation on the compensation control signal Sc output by the compensation control unit 106 (that is, the gate bias of the N-type transistor N3), thereby reducing the impact of the changes of the supply voltage VDD and the ambient temperature on the gate bias of the N-type transistor N3. When the supply voltage VDD or the ambient temperature rises, the voltage and temperature compensation module 108 reduces the compensation bias Vc, to raise the drain voltage of the N-type transistor M4, and maintain (or slightly reduce) the gate bias of the N-type transistor N3 (that is, the voltage level of the compensation control signal Sc), thereby preventing the N-type transistor N3 from being conducted due to the changes of the supply voltage VDD or the ambient temperature. On the contrary, when the supply voltage VDD or the ambient temperature drops, it is designed that the gate bias of the N-type transistor N3 remains unchanged (or slightly rises).

Figure 4:
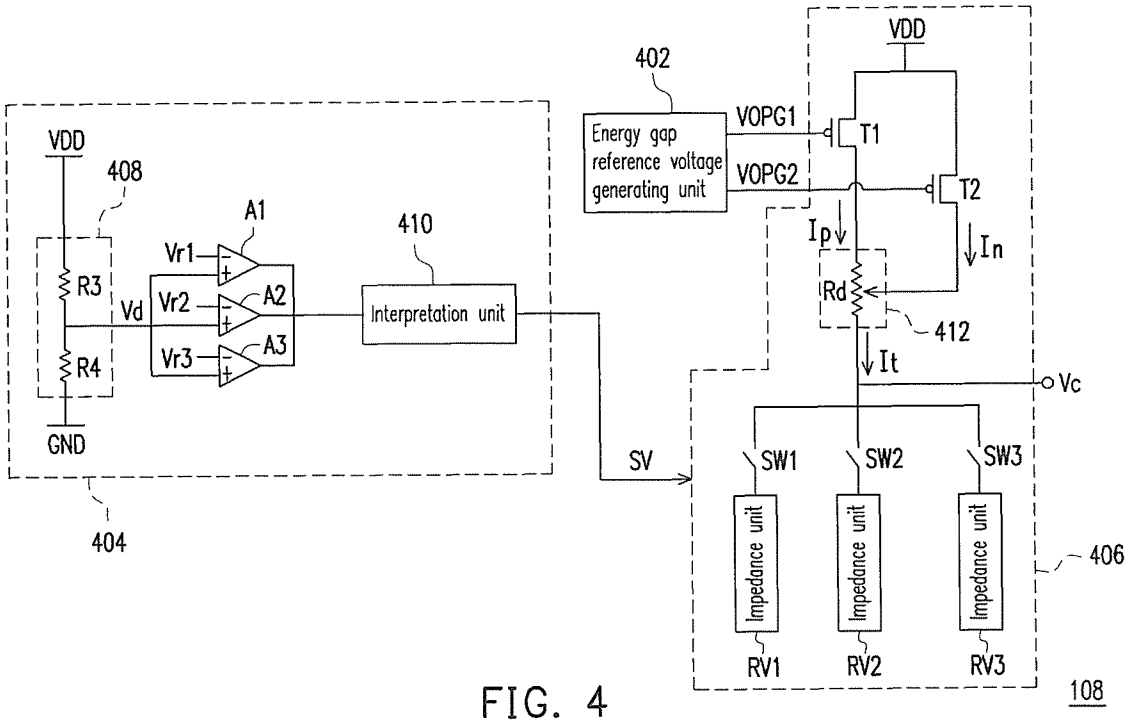
FIG. 4 is a schematic view of a voltage and temperature compensation module according to an embodiment of the present invention.

Particularly, the implementation of the voltage and temperature compensation module 108 is as shown in FIG. 4. FIG. 4 is a schematic view of the voltage and temperature compensation module according to an embodiment of the present invention. Referring to FIG. 4, the voltage and temperature compensation module 108 includes an energy gap reference voltage generating unit 402, a voltage compensation unit 404, and a temperature compensation unit 406. The temperature compensation unit 406 is coupled to the energy gap reference voltage generating unit 402 and the voltage compensation unit 404. The energy gap reference voltage generating unit 402 is used to generate a reference voltage VOPG1 and a reference voltage VOPG2 being directly proportional to the supply voltage and the ambient temperature, and the voltage compensation unit 404 is used to output a voltage compensation control signal SV according to the changes of the supply voltage VDD. In addition, the temperature compensation unit 406 performs the temperature compensation and the voltage compensation according to the reference voltage VOPG1, the reference voltage VOPG2, and the voltage compensation control signal SV, so as to output the compensation bias Vc.

In this embodiment, the voltage compensation unit 404 includes a voltage division unit 408, comparison units A1-A3, and an interpretation unit 410. The temperature compensation unit 406 includes compensation transistors T1 and T2, a current proportion regulation unit 412, switches SW1-SW3, and impedance units RV1-RV3.

The voltage division unit 408 is coupled between the supply voltage VDD and the ground GND, and is, for example, implemented through resistors R3 and R4 serially connected between the supply voltage VDD and the ground GND in FIG. 4. The comparison units A1-A3 respectively have two input ends, in which positive input ends of the comparison units A1-A3 are coupled to the voltage division unit 408 to receive a divided voltage Vd output by the voltage division unit 408, negative input ends of the comparison units A1-A3 are coupled to the reference voltages Vr1, Vr2, and Vr3 in sequence, and output ends of the comparison units A1-A3 are coupled to the interpretation unit 410. The interpretation unit 410 is coupled to the temperature compensation unit 406.

In addition, in the temperature compensation unit 406, a channel width/length ratio of the compensation transistor T1 is greater than a channel width/length ratio of the compensation transistor T2, gates of the compensation transistors T1 and T2 are coupled to the energy gap reference voltage generating unit 402, so as to respectively receive the reference voltage VOPG1 and the reference voltage VOPG2, and sources and drains of the compensation transistors T1 and T2 are respectively coupled to the supply voltage VDD and the current proportion regulation unit 412. The switches SW1-SW3 and the corresponding impedance units RV1-RV3 are respectively serially connected between the current proportion regulation unit 412 and the ground GND, in which the impedance units RV1-RV3 are, for example, implemented by transistors or resistors, and have different impedance values (in this embodiment, it is assumed that RV1>RV2>RV3). The compensation transistors T1 and T2 are respectively used to output a positive temperature compensation current Ip and a negative temperature compensation current In at the drains, and the current proportion regulation unit 412 is, for example, a resistor Rd. By coupling the drain of the transistor T2 to different positions of the resistor Rd, different output compensation biases Vc is obtained, and different proportions of the compensation transistor T1 and the compensation transistor T2 are regulated to determine a current mixing proportion of the positive temperature compensation current Ip and the negative temperature compensation current In, so as to obtain a temperature compensation current It having a current value not being affected by the temperature, or a temperature compensation current It being directly proportional to the temperature, or a temperature compensation current It being inversely proportional to the temperature (in this embodiment, the temperature compensation current It is designed to be inversely proportional to the temperature).

When the supply voltage VDD drops, the voltage division unit 408 divides the supply voltage VDD, and the output divided voltage Vd drops accordingly. The comparison units A1-A3 respectively compare the reference voltages Vr1, Vr2, and Vr3 with the divided voltage Vd, and output comparison results to the interpretation unit 410. The reference voltages Vr1, Vr2, and Vr3 respectively have different voltage values (in this embodiment, it is assumed that Vr1<Vr2<Vr3), and the comparison units A1-A3 output corresponding voltage logic levels at the output ends according to the comparison results. In the case of the supply voltage VDD having different voltage values, the comparison results of the reference voltages Vr1-Vr3 and the divided voltage Vd are as shown in Table 1.

TABLE 1

| Supply Voltage VDD | Comparison Unit A1 | Comparison Unit A2 | Comparison Unit A3 | Corresponding Switch to be Turned on |
|---|---|---|---|---|
| 1.6 V-1.79 V | 0 | 0 | 1 | SW1 |
| 1.8 V-1.99 V | 0 | 1 | 1 | SW2 |
| 2 V | 1 | 1 | 1 | SW3 |

In Table 1, "0" represents that the output of the comparison unit is a low voltage logic level, and "1" represents that the output of the comparison unit is a high voltage logic level. The interpretation unit 410 outputs the voltage compensation control signal SV according to the comparison results of the comparison units Al-A3 to turn on the corresponding switch, so as to regulate the compensation bias Vc. It can be seen from Table 1 that the more the supply voltage VDD drops, the greater the impedance value of the impedance unit corresponding to the turned-on switch is, and the greater the output compensation bias Vc is. For example, when the supply voltage VDD is 1.6 V-1.79 V, the outputs of the comparison units A1-A3 are the low voltage logic level (0), the low voltage logic level (0), and the high voltage logic level (1) in sequence, the interpretation unit 410 outputs the voltage compensation control signal SV according to the three voltage logic levels to turn off the switches SW2 and SW3, and turn on the switch SW1, such that the temperature compensation current It flows through the impedance unit RV1 with the greater impedance value to generate a larger compensation bias Vc.

Figure 5:
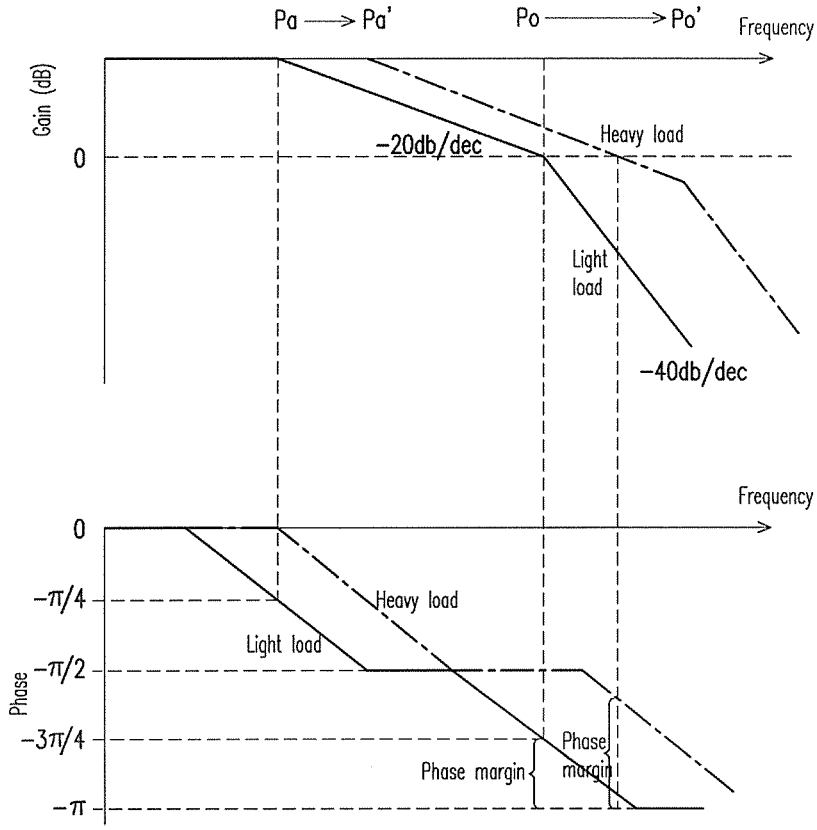
FIG. 5 is a Bode diagram of a frequency response of the LDO voltage regulator according to the embodiment of FIG. 1.

In addition, the voltage value of the compensation control signal Sc generated by the compensation control unit 106 is appropriately designed to make the LDO voltage regulator 100 have excellent stability, and when the current load is increased, a loop bandwidth is extended. When the load capacitor Cout is extremely small, frequency response characteristics of the LDO voltage regulator 100 are exemplarily illustrated in the following. FIG. 5 is a Bode diagram of a frequency response of the LDO voltage regulator 100 according to the embodiment of FIG. 1. Referring to FIGS. 1 and 5, the LDO voltage regulator 100 has two poles Pa and Po, in which the pole Pa is provided by an equivalent resistor Ra (not shown) and an equivalent capacitor Ca (not shown) on the gate of the power transistor P1, and the pole Po is provided by a equivalent resistor Ro (not shown) on the drain of the power transistor P1 in parallel connection with the resistor and the equivalent capacitor Co (not shown) of the voltage division unit 104. In this embodiment, it is assumed that the load capacitor Cout is extremely small, and the main pole of the LDO voltage regulator 100 is the pole Pa.

When the output load current Iload is greater, as the equivalent resistor Ra and the equivalent resistor Ro are inversely proportional to the output load current Iload, the poles Pa and Po both move in a direction of a higher frequency. By using the above function, an appropriate voltage value of the compensation control signal Sc is designed through the compensation control unit 106 in FIG. 2, such that a moving speed of the pole Po in the direction of a higher frequency is greater than or equal to that of the pole Pa, so as to ensure that the LDO voltage regulator 100 is stable with a light load current, and is more stable with a heavy load current. As shown in FIG. 5, when the moving speed of the pole Po is greater than that of the pole Pa (that is, a distance between the pole Po and a pole Po' is larger than a distance between the pole Pa and a pole Pa'), after the moving, the loop bandwidth is extended, and a phase margin is increased, indicating that the LDO voltage regulator 100 is in a more stable state. It should be noted that in other embodiments, when the load capacitor Cout is large enough, the main pole is changed to the pole Po from the pole Pa. In this case, the voltage value of the compensation control signal Sc needs to be designed through a contrary concept, to make the moving speed of the pole Pa in the direction of a higher frequency greater than or equal to that of the pole Po, so as to ensure that the LDO voltage regulator 100 is in the stable state.

To sum up, in the present invention, the compensation control unit outputs the compensation control signal according to the control voltage of the gate of the power transistor, the output voltage of the LDO voltage regulator, and the compensation voltage generated by the voltage and temperature compensation module, such that the compensation bias current source supplies the additional compensation bias current to the error amplifier, so as to accelerate the load transient response of the LDO voltage regulator, and compensate the changes of the supply voltage and the ambient temperature. The voltage level of the compensation control signal is appropriately designed (that is, the gate bias of the N-type transistor implementing the compensation bias current source is designed to be slightly lower than the conduction voltage thereof) to quickly enhance the load transient response of the LDO voltage regulator. Further, the value of the compensation bias is appropriately designed, so that when the LDO voltage regulator is operated with the heavy load current, it is ensured that the moving speed of the sub-pole of the LDO voltage regulator in the direction of a higher frequency is higher than the moving speed of the main pole, thereby ensuring that the loop bandwidth of the LDO voltage regulator is in a more stable state.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A low drop out (LDO) voltage regulator, comprising:

an error amplifier, for generating a control voltage according to a first reference voltage and a feedback voltage;

a power transistor, comprising a gate coupled to the error amplifier and a source coupled to a supply voltage, for generating an output voltage at a drain of the power transistor according to the control voltage;

a first voltage division unit, coupled between the drain of the power transistor and a ground, for dividing the output voltage to generate the feedback voltage;

a compensation control unit, coupled between the gate and the drain of the power transistor, for generating a compensation control signal according to the control voltage, the output voltage, and a compensation bias, wherein the compensation bias is inversely proportional to the supply voltage and ambient temperature; and a compensation bias current source, coupled to the error amplifier, for supplying a compensation bias current to the LDO voltage regulator according to the compensation control signal.

2. The LDO voltage regulator according to claim 1, further comprising:

a voltage and temperature compensation module, coupled to the compensation control unit, for generating the compensation bias, and regulating the compensation bias according to changes of the supply voltage and the ambient temperature.

3. The LDO voltage regulator according to claim 1, further comprising:

a bias current source, coupled to the error amplifier, for supplying a bias current to the error amplifier.

4. The LDO voltage regulator according to claim 1, wherein the first voltage division unit comprises:

a first resistor; and a second resistor, serially connected to the first resistor between the drain of the power transistor and the ground, for generating the feedback voltage at a common node of the first resistor and the second resistor.

5. The LDO voltage regulator according to claim 1, wherein the compensation control unit comprises:

a first drop out detection unit, coupled to the gate of the power transistor, for detecting the control voltage, and outputting a first compensation signal according to changes of a voltage level of the control voltage;

a second drop out detection unit, coupled to the drain of the power transistor, for detecting the output voltage, and outputting a second compensation signal according to changes of a voltage level of the output voltage and the compensation bias; and a compensation control signal generating unit, coupled to the first drop out detection unit and the second drop out detection unit, for outputting the compensation control signal according to the first compensation signal and the second compensation signal.

6. The LDO voltage regulator according to claim 5, wherein the compensation control signal generating unit comprises:

a first P-type transistor, comprising a gate coupled to the second drop out detection unit, and a source and a drain respectively coupled to the supply voltage and the bias current source; and a first N-type transistor, comprising a gate coupled to the first drop out detection unit, and a drain and a source respectively coupled to the drain of the first P-type transistor and the ground.

7. The LDO voltage regulator according to claim 6, wherein the first drop out detection unit comprises:

a second P-type transistor, comprising a gate coupled to the gate of the power transistor, and a source coupled to the supply voltage;

a second N-type transistor, comprising a gate and a source coupled to each other, wherein a drain and the source of the second N-type transistor are respectively coupled to the drain of the second P-type transistor and the ground;

a third P-type transistor, comprising a gate and a drain coupled to each other, wherein a source and the drain of the third P-type transistor are respectively coupled to the supply voltage and the gate of the first N-type transistor; and a third N-type transistor, comprising a gate coupled to the gate of the second N-type transistor, and a drain and a source respectively coupled to the drain of the third P-type transistor and the ground.

8. The LDO voltage regulator according to claim 6, wherein the second drop out detection unit comprises:

a fourth P-type transistor, comprising a gate coupled to the gate of the first P-type transistor, a source coupled to the output voltage, and a drain coupled to the gate of the fourth P-type transistor; and a fourth N-type transistor, comprising a gate coupled to the compensation bias, and a drain and a source respectively coupled to the drain of the fourth P-type transistor and the ground.

9. The LDO voltage regulator according to claim 1, wherein the compensation bias current source comprises:

a fifth N-type transistor, comprising a gate coupled to the compensation control unit, and a drain and a source respectively coupled to the error amplifier and the ground.

10. The LDO voltage regulator according to claim 9, wherein when the LDO voltage regulator is operated at a low load, a gate bias of the fifth N-type transistor is slightly lower than a conduction voltage of the fifth N-type transistor.

11. The LDO voltage regulator according to claim 1, wherein the voltage and temperature compensation module comprises:

an energy gap reference voltage generating unit, for generating a second reference voltage and a third reference voltage;

a voltage compensation unit, for outputting a voltage compensation control signal according to the changes of the supply voltage; and a temperature compensation unit, coupled to the energy gap reference voltage generating unit and the voltage compensation unit, for performing temperature compensation and voltage compensation according to the second reference voltage, the third reference voltage, and the voltage compensation control signal, so as to output the compensation bias.

12. The LDO voltage regulator according to claim 11, wherein the voltage compensation unit comprises:

a second voltage division unit, for dividing the supply voltage to output a divided voltage;

a plurality of comparison units, coupled to the second voltage division unit, for comparing the divided voltage with a plurality of fourth reference voltages respectively; and an interpretation unit, for interpreting comparison results of the comparison units to output the voltage compensation control signal.

13. The LDO voltage regulator according to claim 11, wherein the temperature compensation unit comprises:

a first compensation transistor, comprising a gate coupled to the second reference voltage and a source coupled to the supply voltage, for outputting a positive temperature compensation current at a drain;

a second compensation transistor, comprising a gate coupled to the third reference voltage and a source coupled to the supply voltage, for outputting a negative temperature compensation current at a drain;

a current proportion regulation unit, coupled to the first compensation transistor, the second compensation transistor, and the compensation control unit, for regulating a proportion between the positive temperature compensation current and the negative temperature compensation current, so as to output a temperature compensation current;

a plurality of impedance units, comprising different impedance values; and a plurality of switches, each comprising one end coupled to the current distribution unit and the other end coupled to the corresponding impedance unit, and controlled by the voltage compensation control signal, so as to generate the compensation bias at a common node of the switches and the current distribution unit.

* * * * *

UNITED STATES PATENT AND TRADEMARK OFFICE

CERTIFICATE OF CORRECTION

PATENT NO. : 8,471,539 B2
APPLICATION NO. : 12/978383
DATED : June 25, 2013
INVENTOR(S) : Chen-Yu Wu It is certified that error appears in the above-identified patent and that said Letters Patent is hereby corrected as shown below:

Title Page, item (54) and in the Specification, Column 1, title of the invention "LOW DROP OUT VOLTAGE REGULATO" should be changed to --LOW DROP OUT VOLTAGE REGULATOR--.

Signed and Sealed this
Twentieth Day of August, 2013

Teresa Stanek Rea
*Acting Director of the United States Patent and Trademark Office*